US005124055A

United States Patent [19]

Perozzi

[11] Patent Number: 5,124,055

[45] Date of Patent: Jun. 23, 1992

[54] LUBRICATING OIL COMPOSITION

[75] Inventor: Edmund F. Perozzi, Crestwood, Mo.

[73] Assignee: Ethyl Petroleum Additives, Inc., St. Louis, Mo.

[21] Appl. No.: 494,656

[22] Filed: Mar. 16, 1990

Related U.S. Application Data

[63] Continuation-in-part of Ser. No. 304,772, Jan. 31, 1989, Pat. No. 5,028,345, which is a continuation-in-part of Ser. No. 281,262, Dec. 7, 1988, Pat. No. 4,960,530, which is a continuation-in-part of Ser. No. 175,761, Mar. 31, 1988, abandoned.

[51] Int. Cl.[5] ..... C10M 135/06; C10M 135/02

[52] U.S. Cl. ..... 252/46.7; 252/18; 252/32.7 E; 252/33.2; 252/46.6; 252/47.5; 252/48.6

[58] Field of Search ..... 252/48.6, 46.6, 47.5, 252/46.7

[56] References Cited

U.S. PATENT DOCUMENTS

| | | | |
|---|---|---|---|
| 3,172,892 | 3/1965 | Le Suer et al. | 260/326.5 |
| 3,219,666 | 11/1965 | Norman et al. | 260/268 |
| 3,368,972 | 2/1968 | Otto | 252/47.5 |
| 3,381,022 | 4/1968 | Le Suer et al. | 260/404.8 |
| 3,413,347 | 11/1968 | Worrel | 260/570.5 |
| 3,442,808 | 5/1969 | Triase et al. | 252/49.6 |
| 3,448,047 | 6/1969 | Traise et al. | 252/51.5 |
| 3,455,896 | 7/1969 | Den Herder et al. | 260/39.9 |
| 3,522,179 | 7/1970 | Le Suer et al. | 252/51.5 |
| 3,539,633 | 11/1970 | Piasek et al. | 260/570.5 |
| 3,591,598 | 7/1971 | Traise et al. | 260/296 |
| 3,600,372 | 8/1971 | Udelbofen et al. | 260/132 |
| 3,634,515 | 1/1972 | Piasek et al. | 260/570.5 |
| 3,697,574 | 10/1972 | Piasek et al. | 260/462 R |
| 3,703,536 | 11/1972 | Piasek et al. | 260/462 R |
| 3,704,308 | 11/1972 | Piasek et al. | 260/462 R |
| 3,725,480 | 4/1973 | Traise et al. | 564/367 |
| 3,726,882 | 4/1973 | Traise et al. | 546/304 |
| 3,736,357 | 5/1973 | Piasek et al. | 260/570.5 P |
| 3,740,333 | 6/1973 | Hutchinson et al. | 252/48.6 |
| 3,751,365 | 8/1973 | Piasek et al. | 252/49.6 |
| 3,756,953 | 9/1973 | Piasek et al. | 252/49.6 |
| 3,793,202 | 2/1974 | Piasek et al. | 252/51.5 A |
| 3,798,165 | 3/1974 | Piasek et al. | 252/51.5 R |
| 3,798,247 | 3/1974 | Piasek et al. | 260/404.5 |
| 3,803,039 | 4/1974 | Piasek et al. | 252/51.5 A |
| 3,850,825 | 11/1974 | Vienna et al. | 252/48.6 |
| 3,991,089 | 11/1976 | Schwab et al. | 252/48.6 |
| 4,067,817 | 1/1973 | Sturwold | 252/49.3 |
| 4,149,982 | 4/1979 | Lee et al. | 252/48.6 |
| 4,166,795 | 9/1979 | Recchuite | 252/48.6 |
| 4,166,796 | 9/1979 | Recchuite | 252/48.6 |
| 4,166,797 | 9/1979 | Recchuite | 252/48.6 |
| 4,167,486 | 9/1979 | Rowe | 252/56 R |
| 4,170,560 | 10/1979 | Lowe | 252/47.5 |
| 4,188,300 | 2/1980 | Sanson, III et al. | 252/48.6 |
| 4,201,684 | 5/1980 | Malec | 252/47.5 |
| 4,208,293 | 6/1980 | Zaweski | 252/51.5 |
| 4,234,435 | 11/1980 | Meinhardt et al. | 252/51.5 A |
| 4,380,498 | 4/1983 | Kammann, Jr. | 252/48.6 |
| 4,380,499 | 4/1983 | Kammann, Jr. | 252/48.6 |
| 4,485,044 | 11/1984 | Kammann, Jr. | 260/399 |
| 4,921,624 | 5/1990 | Kammann, Jr. | 252/48.6 |
| 4,957,651 | 9/1990 | Schwind | 252/45 |
| 4,959,168 | 9/1990 | Schroeck | 252/48.6 |
| 4,960,530 | 10/1990 | Everett et al. | 252/48.6 |

FOREIGN PATENT DOCUMENTS

| | | |
|---|---|---|
| 0009701 | 1/1982 | European Pat. Off. . |
| 2023169 | 12/1979 | United Kingdom . |
| 8906682 | 7/1989 | World Int. Prop. O. . |
| 8906683 | 7/1989 | World Int. Prop. O. . |

*Primary Examiner*—Prince Willis, Jr.
*Assistant Examiner*—Ellen M. McAvoy
*Attorney, Agent, or Firm*—John F. Sieberth; Doris M. Thompson

[57] ABSTRACT

Lubricant compositions comprising an oil of lubricating viscosity and a cosulfurized blend of soybean oil and an ester, amide, ester-amide or fatty amine derivative which contains at least one substituent group.

27 Claims, No Drawings

LUBRICATING OIL COMPOSITION

RELATED APPLICATIONS

This application is a continuation-in-part of application Ser. No. 304,772 filed Jan. 31, 1989, now U.S. Pat. No. 5,028,345, which is a continuation-in-part of Ser. No. 281,262 filed Dec. 7, 1988, now U.S. Pat. No. 1,960,530, which is a continuation -in-part of Ser. No. 175,761 filed Mar. 31, 1988, now abandoned. Application Ser. No. 415,580 filed Oct. 2, 1989, now U.S. Pat. No. 4,960,530, is a divisional of U.S. Ser. No. 281,262.

BACKGROUND OF THE INVENTION

1. Field of the Invention

The present invention relates to lubricating oil compositions suitable for use in internal combustion engines and, more particularly, relates to lubricating oil compositions comprising a cosulfurized blend of soybean oil and an ester, amide, ester-amide or fatty amine derivative which contains at least one polar group.

2. Background of the Invention

It has been common practice to include in lubricant formulations additives to provide improved antiwear and rust inhibition properties. In the past, sulfurized triglycerides, such as sulfurized lard oil, have been utilized, especially in association with lightly refined aromatic mineral oils which provided sufficient solubility for the sulfurized triglycerides.

With the increased concern for toxicity of aromatic compounds found in such mineral oils, lubricant formulations now comprise essentially non-aromatic oils. This change to substantially non-aromatic base oils created a major problem, resulting from a significant decrease in solubility of the sulfurized triglycerides in the non-aromatic mineral oil, resulting in solidification and/or dropout of the sulfurized triglycerides.

While the solubility problem has been overcome, the modified lubricant products have been found to be either deficient in desirable lubricant properties or incapable of providing needed improvement in these properties.

In a typical approach to this problem, as reported in U.S. Pat. No. 3,455,896, sulfurized, low molecular weight polybutenes were reacted with liquid triglycerides, which were susceptible of sulfurization, to yield an additive. In U.S. Pat. No. 3,850,825, another additive was prepared by the sulfurization of a mixture of prime burning lard oil and alkyl oleate. In U.S. Pat. No. 3,740,333, $C_{10}$–$C_{16}$ alcohol esters of unsaturated fatty acids, having 18 to 22 carbon atoms, were blended with a triglyceride and either used "as is" or sulfurized. Modifications of such compositions have been reported in U.S. Pat. Nos. 4,149,982, 4,166,795, 4,166,796, 4,166,797 and U.S. Pat. No. 4,188,300. Esters of polymer acids have been employed as additives for metal-working aqueous dispersants and as fuel lubricant additives in, respectively, U.S. Pat. Nos. 4,067,817 and 4,167,486.

In U.S. Pat. No. 4,485,044 it is disclosed that the triglyceride compositions of the prior art, typically derived from plants and animals, have not provided maximum effectiveness as lubricant additives because of the chain length and/or the degree of unsaturation of the acid moiety. Thus, it is proposed to sulfurize esters of unsaturated dibasic carboxylic acids which may be sulfurized in the presence of transesterified triglycerides. It is further stated that modification of the acid moieties of the triglycerides, as by transesterification disclosed in U.S. Pat. Nos. 4,380,498 and 4,380,499, have produced novel triglycerides and have improved the properties of the resulting additive when said novel triglycerides were coupled, through sulfur bonds, with solubilizing components, such as esters and/or olefins.

Although these prior art efforts have increased the solubility of sulfurized fatty oils to acceptable values, there has remained a serious need for sulfurized additives possessing both good solubility and a combination of improved lubricant properties, such as, for example, better antifriction properties, and better anti-oxidation properties, leading to less sludging and gumming.

SUMMARY OF INVENTION

It has now been discovered that a cosulfurized blend of a soybean oil and an ester, amide, ester-amide or fatty amine derivative which contains a polar group provides unexpected antifriction properties as well as improved lubricant properties. Accordingly, the present invention is directed to such cosulfurized blend and to concentrates and lubricating oils containing such blend.

DETAILED DESCRIPTION OF THE INVENTION

The subject compositions are cosulfurized blends of a fatty acid ester material, namely, soybean oil, and an organic acid ester, amide, ester-amide or fatty amine derivative which contains at least one polar group.

The term "organic acid" as used herein includes aliphatic carboxylic acids, organic phosphorus acids, and organic sulfur acids, Examples of the types of organic acid ester, amide and ester-amide derivatives suitable for use in conjunction with the carboxylic acid ester material to form the cosulfurized blends include:

A. Fatty acid esters, fatty acid amides and fatty acid ester-amides of an oxyalkylated amine or mixtures thereof, the amine having the formula:

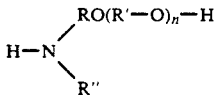

wherein R is a divalent aliphatic hydrocarbon radical containing 1–4 carbon atoms, R′ is a divalent aliphatic hydrocarbon radical containing 1–4 carbon atoms (preferably 2–4), n is an integer from about 0 to 20, preferably 0 to 10, R″ is selected from hydrogen and the group $-RO(R'O)_n-H$.

Optically, the fatty acid moiety can be sulfurized. Such sulfurized compounds can be made by reacting a sulfurized fatty acid with an oxyalkylated amine (e.g. diethanolamine) as disclosed, for example, in U.S. Pat. No. 4,201,684 whose teachings are incorporated by reference. Sulfurized fatty acids can be made by heating a mixture of fatty acids with a elemental sulfur at temperatures of from about 100° to 250° C. with or without a catalyst such as 2,5-dimercapto-1,3,4,thiadiazole (DMTD) as known in the art.

Another method is to first make the fatty acid ester, amide or ester-amide by reacting a fatty acid with an oxyalkylated amine (e.g. diethanolamine) as disclosed, for example, in U.S. Pat. No. 4,208,293 whose teachings are incorporated by reference, and then reacting that intermediate with elemental sulfur at elevated temperature (e.g. 100° to 250° C.) with or without a catalyst such as DMTD.

The ester, ester-amide, and amide components can be separated by distillation and used separately in lubricating oil compositions or they can be used as mixtures. When equal mole mixtures of fatty acid and dialkanolamine are reacted, very little ester-amide forms and the product contains mainly amide because of the greater reactivity of the HN< group. However, when over one mole of fatty acid is reacted with a mole of dialkanolamine increased amounts of ester-amide can form. the preferred amines used to make the compounds are alkoxylated amines such ad methanolamine, ethanolamine, dimethanolamine, diethanolamine, 2-isopropanolamine and the like. As stated previously, these can be reacted to form both amides, esters and ester-amides. Using diethanolamine as an example, sulfurized oleic acid, (S)oleic reacts as follows:

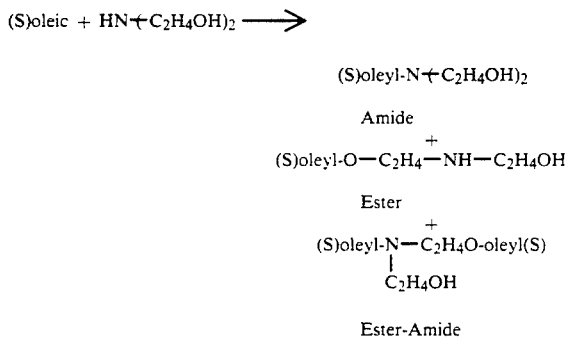

The compounds can be further reacted with alkylene oxide as described in U.S. Pat. No. 45,201,684 to form a polyoxyalkylene chain $[R'—O)_n$ as defined above in the formula for the amine where R' contains 2–4 carbons and when n>1]. Preferred fatty acids used in making the amide, ester, ester-amide compounds are those containing about 8–20 carbon atoms. Examples of these are hypogenic acid, oleic acid, linoleic acid, elaidic acid, abietic acid, dihybroabietic acid, dehydroabietic acid, tall oil fatty acids, erucic acid, brassidic acid, caprylic acid, pelargonic acid, capic acid, undecylic acid, lauric acid, tridecoic acid, myristic acid, palmitic acid, stearic acid, arachidic acid and mixtures thereof. Most preferably, the fatty acid component is a mixture of acids derived from coconut oil.

B. Fatty acid amides of polyamines represented by the formula:

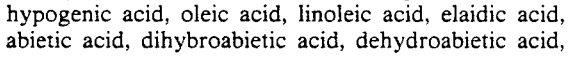

where N=2 or 3 and m is 0 to 10. Specific examples of suitable amines include ethylene diamine, diethylene triamine, triethylene tetramine. Preferred fatty acids are those described in (A) above which can be sulfurized. The fatty acid amides can be prepared by reacting the fatty acid with the amine as known in the art. For example, oleic acid with diethylene traimine as follows:

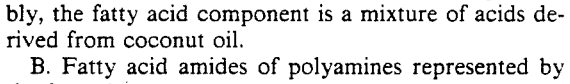

C. Fatty acid partial esters of polyhydric alcohols which preferably contain 2 to 4 free hydroxyl groups. Suitable polyhydric alcohols for forming the esters contain 3 to about 6 hydroxyl groups and include, for example, glycerol, diglycerol, pentaerythritol, trimethylolethane, trimethylolpropane, 1,2,4-butanetriol, 1,2,6-hexametriol, sorbitol and mannitol and the like. The esters are formed by reacting the polyhydric alcohol with a fatty acid such as described in (A) above at mole ratios to provide a partial ester which contains at least one and preferably two or more free hydroxyl groups. A preferred ester is glycerol monooleate which is commercially available. The glycerol esters can also be obtained by partial saponification of fatty oils. Oxyalkylated derivatives can also be used such as are formed by the reaction of glycerol monooleate with ethylene oxide.

D. Phosphoramides, esters and amine derivatives of oxy- and thio-alkyl phosphorus acids with (1) oxyalkylated amines as described in (A) above, (2) polyamines as described in (B) above, and (3) polyhydric alcohols can be formed, for example, by reacting the amine or alcohol with an acid chloride of a dialkyl phosphorus acid of the formula:

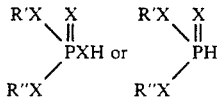

where R' and R'' are independently selected from hydrocarbyl radicals containing from about 4 to 20 carbons and X is selected from oxygen and sulfur including various combinations thereof. The hydrocarbyl group is preferably selected from $C_8$–$C_{20}$ alkyl or alkenyl to provide oil solubility. As in the case of the Class A materials, the reaction of the acids and oxyalkylated amines forms not only amides but esters and ester-amides. The dialkyl phosphorus acids can be prepared, for example, by reacting one or more alcohols, containing about 4 to 20 carbons, such as n-buanol, isobutanol, t-butanol, 2-butanol, pentanol, hexanol, cyclohexanol, 2-ethylhexanol, 1-decanol, 1-dodecanol, cetyl alcohol, and stearyl alcohol with an inorganic phosphorus pentasulfide as is known in the art. The acid chlorides can be prepared by reaction of the acid with chlorine as known in the art, for example:

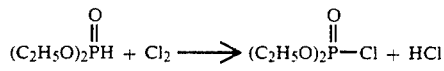

The amine derivatives which can also be considered as being esters of the phosphorus acid can be prepared by reacting a dialkylphosphate with formaldehyde and a dialkanol amine, for example, as follows:

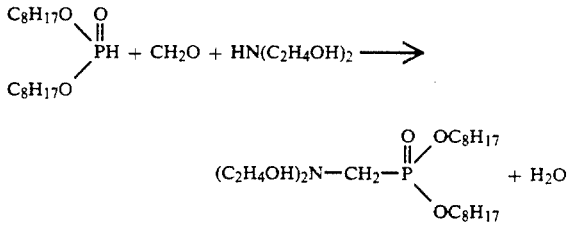

E. Sulfornamides and esters of alkylsulfonic acids with (1) oxyalkylated amines as described in (A) above, (2) polyamines as described in (B) above, and (3) polyhydric alcohols as described in (C) above. The alkyl group of the sulfonic acid generally contains from about 4 to 50 carbons, and preferably at least about 8 carbons for oil solubility, and can be a straight or branched chain. Suitable alkyl groups include polyalkenes such as polyisobutyloene (PIB) having a molecular weight, $M_n$, of from about 250 to 5,000. Sulfonamides can be formed by reacting the corresponding sulfonyl chloride with the amine or alcohol for example as follows:

$$C_8H_{17}OH + SOCl_2 \longrightarrow C_8H_{17}O\overset{\overset{\displaystyle O}{\|}}{S}Cl + HCl$$

$$C_8H_{17}O\overset{\overset{\displaystyle O}{\|}}{S}Cl + HN(CH_2CH_2OH)_2 \longrightarrow C_8H_{17}O\overset{\overset{\displaystyle O}{\|}}{S}N(CH_2CH_2OH)_2 + HCl$$

Other derivatives can be prepared by reacting alkylenes or alcohols with sulfur trioxide to form a sulfonic acid intermediate which is then reacted with an amine, for example as follows:

$$\text{polyisobutylene (PIB)} + SO_3 \rightarrow PIB-SO_3H$$

$$PIB-SO_3H + HN(CH_2Ch_2OH)_2 \rightarrow PIB-SO_2N(CH_2CH_2OH)_2$$

$$C_8H_{17}OH + SO_3 \rightarrow C_8H_{17}OSO_3H$$

$$C_8H_{17}OSO_3H + HN(CH_2CH_2OH)_2 \rightarrow C_8H_{17}OSO_2N(CH_2CH_2OH)_2$$

As in the case of the Class A materials the reaction of the sulfuric acid derivatives and oxyalkylated amines forms not only amides but esters and ester-amides by reaction of the acid with the hydroxyl groups on the amine.

Suitable fatty amines for use in the invention include fatty amines of the formula:

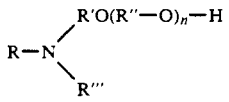

wherein R is an aliphatic hydrocarbon group containing about 12–36 carbon atoms, R′ is a divalent aliphatic hydrocarbon radical containing 1–4 carbon atoms, R″ is a divalent aliphatic hydrocarbon radical containing 1–4 carbon atoms (preferably 2–4), n is an integer from 0 to 20, preferably 1–10, and R‴ is selected from hydrogen and the group $-R'O(R''-O)_n-H$. Examples of such amines are described, for example in U.S. Pat. No. 4,231,883 whose teachings are incorporated by reference. Such amines include N, N-bis(2-hydroxyethyl)-oleylamine, N,N-bis(2-hydroxyethoxyethyl)-1-methyl-undercylamine, and N-(2-hydroxyethyl)-N-(2-hydroxyethoxyethyl)-n-dodecylamine.

Other similar esters and amides of the organic acids which contain at least one polar substituent group can also be used provided they have sufficient solubility in oils when consulfurized with the fatty acid ester materials. The derivatives can be sulfurized prior to consulfurization but this is not necessary.

The materials which are useful in forming the cosulfurized blends with fatty acids esters and especially the diol containing materials can be further reacted with a boronating agent such as boron acids, e.g. $H_3PO_3$, and boron oxides, e.g. $B_2O_3$, and such boronated materials are considered to be within the scope of this invention.

In order to form the cosulfurized products, the carboxylic acid ester material and the fatty amine, organic acid ester, amide and ester-amide derivative are mixed in proportions of from about 20 to 80 percent by weight of carboxylic acid ester material and from about 80 to 20 percent by weight of the fatty amine, organic ester and/or amide derivative (preferably in a range of 40–60 percent of each component) based on the weight of the mixture, and then heated with from about 1 to 10 percent by weight of elemental sulfur based on the total weight of mixture at a temperature of from about 100° to 250° C. and preferably from about 140° to 180° C. with or without a catalyst for from about ½ to 2 hours. Suitable catalysts as known in the art include 2,5-dimercapto- 1,3,4-thiadiazole DMTD and alkyl amines such as PRIMENE® 81-R ($RC(CH_3)_2NH_2$ where R is $C_{12}$–$C_{14}$). The cosulfurized mixtures preferably contain from about 2 to 10 percent by weight sulfur and most preferably from about 5 to 7 percent by weight with the amount of elemental sulfur in the reaction being adjusted to provide the desired sulfur content.

The cosulfurized blends can be used in mineral oil or in synthetic oils of suitable viscosity for the desired lubricant application. Crankcase lubricating oils have a viscosity up to about 80 SUS at 210° F.

Preferred crankcase lubricating oils for use in the invention have a viscosity up to about SAE 40. Sometimes such motor oils are given a classification at both 0° and 210° F., such as SAE 5W30.

Mineral oils include those of suitable viscosity refined from crude oil from all sources including Gulf Coasts, Mid-continent, Pennsylvania, California, Alaska and the like. Various standard refinery operations ca be used in processing the mineral oil.

Synthetic oil includes both hydrocarbon synthetic oil and synthetic esters. Useful synthetic hydrocarbon oils include polymers of alpha-olefins having the proper viscosity. Especially useful are the hydrogenated liquid oligomers of $C_{6-12}$ alpha-olefins such as alpha-decene trimer. Likewise, alkylbenzenes of proper viscosity can be used, such ad didodecylbenzene.

Useful synthetic esters include the esters of both monocarboxylic acid and polycarboxylic acid as well as monohydroxy alkanols and polyols. Typical examples are didodecyl adipate, trimethylo/propane tripelargonate, pentarythritol tetracaproate, di-(2-ethylhexyl)adipate, dilauryl sebacate and the like. Complex esters prepared from mixtures of mono- and dicarboxylic acid and mono- and polyhydrxyl alkanols can also be used.

Blends of mineral oil with synthetic oil are also useful, for example, blends of 5–25 percent weight hydrogenated alpha-decane trimer with 75–95 percent weight 150 SUS (100° F.) mineral oil. Likewise, blends of about 5–25 percent weight di-(2-ethylhexyl)adipate with mineral oil of proper viscosity results in a useful lubricating oil. Also, blends of synthetic hydrocarbon oil with synthetic esters can be used. Blends of mineral oil with synthetic oil are useful when preparing low viscosity oil (e.g. SAE 5W30) since they permit these low viscosities without contributing excessive volatility.

The amounts of cosulfurized blend in the lubricating oil generally range from about 0.05 to about 6.0 percent by weight for crankcase applications (preferred 0.3 to 3..5) based on the total weight of lubricating oil composition although larger amounts can be used depending upon the application, e.g. up to about 20 percent by weight.

The lubricating oil compositions of the present invention for crankcase use preferably contain an overbased alkaline earth etal sulfonate, zinc dithiphosphate and an ashless dispersant. They can also contain any of the other additives conventionally added to such compositions such as, for example, wear-inhibitors, friction reducers, viscosity index improvers, antioxidants, dispersants, detergents such as neutral alkaline earth metal sulfonates, antifoam agents, pour point depressants and the like provided, of course, that the presence of such additional additives in the compositions does not significantly interfere with the benefits provided by the additives of the present invention.

A combination of overbased alkaline earth metal sulfonate and zinc dihydrocarbyl dithiophosphate along with the cosulfurized materials provide enhanced anti-wear properties. The combination of an ashless dispersant and the cosulfurized blends of the invention provide synergistic anti-sludge properties.

Suitable overbased alkaline earth metal sulfonates have a base number of at least 100, more preferably at least about 300. The "total base number" (TBN) also referred to as "base number" is a measure of the alkaline reserve in the product in terms of its stoichiometric equivalent of mg KOH per gram of product (ASTM D-2896).

Overbased alkaline earth metal sulfonates are derived from sulfonic acids, particularly from petroleum sulfonic acids, polyalkylene sulfonic acids or alkylated benzene sulfonic acids. Useful sulfonic acids from which the overbased alkaline earth metal sulfonates are prepared have an average molecular weight of about 250-5,000, more preferably about 400-1,100, and most preferably about 440-600. Examples of specific sulfonic acids include mahogany sulfonic acids, petrolatum sulfonic acids, alphatic sulfonic acids and cycloaliphatic sulfonic acids. In a highly preferred embodiment, the sulfonic acids are alkaryl sulfonic acids such as alkylbenezene or alkylnaphthalene sulfonic acids. Suitable alkyl groups contain from 10 to about 30 carbon atoms or more. Likewise, higher molecular weight alkyls derived from alkylation with polyolefin (e.g. polybutenes) having molecular weights up to about 2,000 can be used to give hydrocarbyl sulfonic acids somewhat above the preferred range, but still useful.

Preferred sulfonic acids are the alkaryl sulfonic acids also referred to as alkylbenezene sulfonic acids.

Alkaryl sulfonic acids can be made by conventional methods such as by alkylating benzene, toluene or naphthalene or aromatic mixtures with olefins containing about 10-30 carbon atoms or more (e.g. with polyolefin), the most suitable olefins are cracked-wax olefins, propylene trimers and tetramers and olefin mixtures derived from aluminum alkyl chain growth. Alkylation is effected using a Friedel-Crafts (e.g. $AlCl_3$ or $BF_3$) catalyst. The alkylaromatic mixture contains predominantly mono- and di-alkyl products. These alkyl aromatics are then sulfonated by known methods such as by reaction with sulfuric acids, oelum, sulfur trioxide and the like.

Thus, preferred sulfonic acids include octadecylbenezene sulfonic acids, didodecylbenzene sulfonic acids, docosylbenezene sulfonic acid, triacontylbenezene sulfonic acid, dodecyloctadecyl-benzene sulfonic acid, didodecylbenzene sulfonic acid, dodecylnapthalene sulfonic acid, hexadecylnaphthalene sulfonic acid, dinonylbenezene sulfonic acid and mixtures thereof and the like.

The hydrocarbyl sulfonic acids preferably have an average molecular weight of about 250-5,000. More preferred are the alkylbenezene sulfonic acids having an average molecular weight of about 400-1,100 and most preferably 440-600.

The overbased alkaline earth metal sulfonates are produced by neutralizing the sulfonic acids with an alkaline earth metal base to form an alkaline earth metal sulfonate salt and then overbasing the alkaline earth metal sulfonate with the corresponding alkaline earth metal carbonate. The process is conducted to give a total base number of at least 100, more preferably at least 300. There is no real maximum on total base number, but for practical purposes they seldom exceed about 550.

Overbased calcium petroleum sulfonates or alkaryl (e.g. alkylbenezene) sulfonates are especially preferred. These are prepared by neutralizing the corresponding petroleum sulfonic acid or alkylated benzene sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water.

Such additives are available commercially. For example, an overbased calcium sulfonate produced from a synthetic benzene sulfonic acid having a TBN of 310 can be obtained from Ethyl Petroleum Additives, Inc. under the designation HiTEC® 611.

Useful zinc dihydrocarbyldithiophosphates (ZDDP) include both zinc dialkyldithiophosphates and zinc dialkarylkithio-phosphates as well as mixed alkyl-aryl ZDDP. A typical alkyl-type ZDDP contains a mixture of isobuty and isoamyl groups. Zinc dinonylphenyldithiophosphate is a typical aryl-type ZDDP.

Preferred zine dithiophosphate components are represented by the formula:

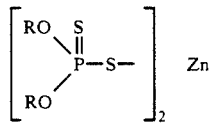

in which R is a hydrocarbyl radical having from 3 to 12 carbon atoms. The most preferred since dithiophosphates are those in which R represents an alkyl radical having from 3 to 8 carbon atoms such s isopropyl, isobutyl, isoamyl and 2-ethylhexyl. Examples of suitable compounds include zinc isobutyl 2-ethylhexyl dithiophosphate, since di(2-ethylhexyl)-dithiophosphate, since isopropyl 2-ethylhexyl dithiophosphate, since isoamyl 2-ethylhexyl dithiophosphate and zinc dinonylphenyldithiophosphate.

Such additives are also available commercially. For example, a mixed 2-ethylhexyl, 2-methylpropyl, isopropty ester of phosphorodithioic acid, zinc salt can be obtained from Ethyl Petroleum Additives, Inc under the designation HiTEC® 685.

Most preferred crankcase oils also contain an ashless dispersant such as the polyolefin-substituted succinamids and succinimides of polyethylene polyamines such as tetraethylene-pentamine. The polyolefin succinic substituent is preferably a polyisobutylene group having a number average molecular weight of from about 800 to 5,000 and preferably from about 1,000 to 2,000. Such ashless dispersant are more fully described in U.S. Pat. No. 3,172,892, U.S. Pat. No. 3,219,666 and U.S. Pat. No. 4,234,435 incorporated herein by reference.

Another useful class of ashless dispersants are the polyolefin succinic esters of mon-and polyhydroxyl alcohols containing 1 to about 40 carbon toms. Such dispersants are described in U.S. Pat. NO. 3,381,022 and U.S. Pat. No. 3,522,179.

Likewise, mixed ester/amide of polyolefin substituted succinic acid made using alkanols, amines and/or amino alkanols represent a useful class of ashless dispersants.

The succinic amide, imide and/or ester type ashless dispersants may be boronated by reaction with a brown compound such s boric acid. Likewise, the succinic amide imide and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamien. Preferably, the poly olefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. No. 3,368,972; U.S. Pat. No. 3,413,347; U.S. Pat. No. 3,442,808; U.S. Pat. No. 3,448,047; U.S. Pat. No. 3,539,633; U.S. Pat. No. 3,591,598; U.S. Pat. No. 3,600,371; U.S. Pat. No. 3,634,515; U.S. Pat. No. 3,697,574; U.S. Pat. No. 3,703,480; U.S. Pat. No. 3,726,882; U.S. Pat. No. 3,736,357; U.S. Pat. No. 3,751,365; U.S. Pat. No. 3,756,953; U.S. Pat. No. 3,793,202; U.S. Pat. No. 3,798,165; U.S. Pat. No. 3,798,247; and U.S. Pat. No. 3,803,039.

The above Mannich dispersants can be reacted with boric acid to form boronated dispersants having improved corrosion properties.

Viscosity index improvers can be included such as the polyalkylmethacrylate type or the ethylene-propylene copolymer type including graft copolymers with a N-alkyl amide such as dialkyl formamide. Likewise, styrene-diene VI improvers or styrene acrylate copolymers can be used. Alkaline earth metal salts of phosphosulfurized polyisobutylene are useful.

Conventional blending equipment and techniques may be used in preparing the lubricating oil compositions of the present invention. In general, a homogeneous blend of the foregoing active components in achieved by merely blending the components separately, together or in an combination or sequence with the lubricating oil in a determined proportion sufficient to provide the lubricating oil composition with the desired properties. This is normally carried out at ambient temperature to about 70° C. The selection of the particular base oil and components, as well as the amounts and ratios of each depends upon the contemplated application of the lubricant and the presence of other additives. In general, however, the amount of overbased alkaline earth metal sulfonate in the lubricating oil can vary from about 0.5 to 5.0, and usually from about 0.75 to 2.5 weight percent based on the weight of the final composition. The amount of zinc dihydrocarbyl dithiophosphate in the lubricating oil can very from about 0.5 to 3.0, and usually from about 1.0 to 2.0 weight percent based on the weight of the final composition. The amount of ashless dispersant in the lubricating oil can vary from about 2 to 8, and usually from about 3 to 6 weight percent based on the weight of the final composition the amount of cosulfurized blend in the lubricating oil can vary from about 0.05 to 6.0, and usually from about 0.3 and 3.5 weight percent based on the weight of the final composition.

In many cases, a preferred way to add the additives to lubricating oil is in the form of an additive package. These are concentrates dissolved in a diluent such as mineral oil, synthetic hydrocarbon oils and mixtures thereof which, when added to a base oil, will provide an effective concentration of the present additives and other known conventional additives such as those listed above. The various additives are present in a proper ratio such that when a quantity of the concentrate is added to lubricating oil the various additives are all present in the proper concentration. For example, if the desired use level of a particular additive component is 0.2 weight percent and the final formulated oil is made by adding 10 parts of the additive package to 90 parts of base lubricating oil, then the additive pack will contain 2.0 weight percent of that particular additive component. Usually the concentrate will be 95.0 to 99.9 percent by weight additive composition and from 5.0 and 0.1 percent by weight lubricating oil diluent. Preferably, the additive composition comprises 97 to 99 percent by weight of the lubricating oil additive concentrate. This concentrate is diluted with additional lubricating oil before use such that the finished lubricating oil product contains from about 5.0 to 25.0 percent by weight of concentrate. Accordingly, typical amounts of ashless dispersant in a concentrate would range from about 40 to 60 weight percent of total concentrate and typical amounts of ZDDP or overbased alkaline earth metal sulfonate would range from about 10 to 20 weight percent of total concentrate.

The following examples illustrate the preparation of cosulfurized blends for use in lubricants.

EXAMPLE 1

A mixture of 60 grams of coconut oil fatty acid diethanol amide (Schmecomid ® SCO-extra), 90 grams of soybean oil, 9.57 grams of sulfur and 0.80 grams of 2,5-dimercapto-1,3,4-thiadiazole (DMTD) as catalyst are heated at about 160° C. for 30 minutes with stirring while allowing water vapor to escape and then cooled to void side reactions. The product contains 6 percent by weight sulfur.

EXAMPLE 2

A mixture of 60 grams of glycerol monooleate, 90 grams of soybean oil, 9.57 of sulfur and 0.80 grams of DMTD as catalyst are heated at about 160° C. for 30 minutes with stirring. About 157 grams of product is recovered.

EXAMPLE 3

A reaction product of glycerol monooleate and ethylene oxide is prepared by mixing 3.0 grams of catalyst (Amberlyst ® 15 Mallinckrodt) and 150 grams of glycerol monooleate in a flash equipped with a stirrer, a gas inlet tube, a dry ice-isopropyl alcohol condenser and a thermometer, and then heated to 100° C. Ethylene oxide is fed to the reaction mixture through the gas inlet tube for about 3 hours at temperatures of from about 40° C. to 107° C. The weight increase of the reaction mixture is about 5.2 grams indicating the combination of that amount of ethylene oxide with the glycerol monooleate. The product is filtered and cosulfurized with soybean oil according to the following procedure.

A mixture of 60 grams of the glycerol monooleate-ethylene oxide product prepared above, 90 grams of soybean oil, 9.57 grams of sulfur and 0.80 gram of DMTD is heated with stirring t from about 158° to 167° C. for 30 minutes to prepare a cosulfurized blend of the soybean oil and glycerol monooleate-ethylene oxide product.

EXAMPLE 4

A reaction product of amine and fatty acid can be prepared by heating (180°-200° C.) a mixture of 100 grams, 0.538 mole, of coconut oil fatty acid and 55.4 grams, 0.538 mole of diethylene triamine. The product is expected to be a mixture of primary and secondary amides. The product can then be cosulfurized by reaction with sulfur and soybean oil following the procedures described in the foregoing examples.

the following formulation illustrates a typical additive mixture within the scope of this invention. Parts are by weight.

Zinc dialkydithiophosphate: 0.5-3.0 parts
Overbased calcium alkylbenezene sulfonate (TBN 310): 0.5-5.0 parts
Consulfurized blend: 0.05-6.0 parts In addition to providing engine wear reduction properties to lubricating oil compositions formulations for use in engine crankcases, the additive combinations of the present invention also impart detergency properties to lubricating oils containing same so as to inhibit sludge formation.

Accordingly, the presence of the cosulfurized blend has been found to provide a compatible lubricant oil additive package which significantly reduces engine war and sludge formation as determined by laboratory bench and engine testing. Generally, suitable amounts of the blend to inhibit sludge range from about 0.05 weight percent of SUL-PERM® 60-93 additive (which is a cosulfurized blend of transesterified triglycerides and the reaction product of diethanol-amine and fatty acids derived from coconut oil) and Blend B includes 0.35 weight percent of the cosulfurized blend f Example 1. Blends A and B are fully formulated 5W30 oils made by combining a base oil with zinc dialkydithiophosphate ester (ZDDP) antiwear, neutral and overbased calcium sulfonate detergents, alkenylsuccinimide ashless dispersant, antioxidants, antifoam agent pour point depressant, and viscosity index (VI) improver.

Results of the VE engine test are reported in Table 1.

TABLE 1

| Blend | Rocker Cover Sludge | Average Sludge[1] | Average Varnish[2] | Max Wear (ml) | Average Wear (ml) |
|---|---|---|---|---|---|
| A | 8.28 | 9.05 | 5.89 | 8.3 | 3.34 |
| B | 9.18 | 9.39 | 6.81 | 0.7 | 0.44 |

[1]Rating Scale: 10 is a perfectly clear (sludge free) engine: 9 is a "pass".
[2]For varnish ratings, a higher number indicates that less varnish is seen on a piston of the engine. 10 is "perfect".

These results show that utilization of this particular triglyceride material, namely, soybean oil, in compositions of this type provides significant improvements in sludge formation inhibition, in varnish reduction and, most importantly, in reduced wear.

What is claimed is:

1. A lubricant composition comprising a major amount of an oil of lubricating viscosity and a minor amount of a cosulfurized blend comprising (a) soybean oil and (b) an organic acid ester, amide, ester-amide, or fatty amine derivative which contains at least one polar substituent group, said ester, amide, or ester-amide derivative being selected from the group consisting of:

(1) a fatty acid amide of a polyamine of the formula:

$$NH_2(CH_2)_n—(NH(CH_2)_n)_m—NH_2$$

wherein n=2 or 3, and m is 0 to 10;

(2) a phosphoramide or an oxy- or thio-alkyl phosphorus acid with an oxyalkylated amine or a polyamine;

(3) an ester of an oxy- or thio-alkyl phosphorus acid with an oxyalkylated amine or a polyhydric alcohol;

(4) an ester-amide of an oxy- or thio-alkyl phosphorus acid with an oxyalkylated amine;

(5) a sulfonamide of an alkylsulfonic acid with an oxyalkylated amine or a polyamine;

(6) an ester of an alkylsulfonic acid with a polyhydric alcohol; and (7) a compound of the formula:

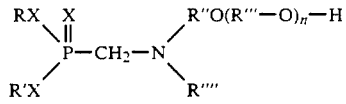

wherein each X is independently selected from sulfur and oxygen, R and R' are independently selected from hydrocarbyl radicals containing from about 4 to 20 carbons, R'' and R''' are, individually, divalent aliphatic hydrocarbon radicals containing 1-4 carbon atoms, n is an integer from 0 to 20, and R'''' is selected from hydrogen and the group —R''O(R'''O)$_n$—H.

2. A lubricant composition according to claim 1 wherein said oxyalkylated amine has the formula:

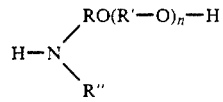

wherein R is a divalent hydrocarbon radical containing 1-4 carbon atoms, R' is a divalent aliphatic hydrocarbon radical containing 1-4 carbon atoms, n is an integer from 0 to 20 and R'' is selected from hydrogen and the group —RO(R'O)$_n$—H.

3. A lubricant composition according to claim 2 wherein said oxyalkylated amine is diethanolamine.

4. A lubricant composition of claim wherein the cosulfurized blend contains, based on the weight of the blend, from about 1 to 10 percent by weight of sulfur.

5. A lubricant composition of claim 1 which also contains a minor amount of ashless dispersant.

6. A lubricant composition of claim 5 wherein the ashless dispersant is a polyolefin-substituted succinimide of a polyethylene polyamine.

7. A lubricant composition of claim 1 which also contains minor amounts of overbased alkaline earth metal sulfonate having a total base number of at least 100 and of zinc dihydrocarbyldithiophosphate.

8. A lubricant composition of claim 5 which also contains minor amounts of overbased alkaline earth metal sulfonate having a total base number of at least 100 and of zinc dihydrocarbyldithiophosphate.

9. A lubricant composition of claim 1 which contains, based on the weight of the lubricant composition, from about 0.05 to 6.0 weight percent of said cosulfurized blend.

10. A lubricant composition of claim 7 which contains, based on the weight of the lubricant composition, from about 0.5 to 5.0 weight percent of said sulfonate, from about 0.5 to 3.0 weight percent of said zinc dihydrocabyldithiophosphate, and from about 0.05 to 6.0 weight percent of said secularized blend.

11. A lubricant composition of claim 5 which contains, based on the weight of the lubricant composition, from about 2.0 to 8.0 weight percent of said ashless dispersant and from about 0.05 to 6.0 weight percent of said cosulfurized blend.

12. A lubricant composition of claim 8 which contains, based on the weight of lubricant composition, from about 0.05 to 6.0 weight percent of said cosulfurized blend, from about 2.0 to 8.0 weight percent of said ashless dispersant, from about 0.5 to 5.0 weight percent of said sulfonate and from about 0.5 to 3.0 weight percent of said zinc dihydrocarbyldithiophosphate.

13. A composition of claim 1 wherein said cosulfurized blend contains, based on the weight of the blend, from about 1 to 10 percent by weight of sulfur, and wherein said composition contains, based on the weight of the composition, from about 0.05 to 6.0 weight percent of said cosulfurized blend.

14. A composition of claim 13 which contains, based on the weight of the composition, from about 2.0 to 8.0 weight percent of ashless dispersant, from about 0.5 to 5.0 weight percent of overbased alkaline earth metal sulfonate having a total base number of at least 100, and from about 0.5 to 3.0 weight percent of zinc dihydrocarbyldithiophosphate.

15. An additive concentrate adapted for addition to a lubricating oil suitable for use in the crankcase of an internal combustion engine comprising a diluent oil and from about 2.0 to about 25 percent by weight, based on the total weight of concentrate, of a cosulfurized blend which includes (a) soybean oil and (b) an organic acid ester, amide, ester-amide, or fatty amine derivative which contains at least one polar substituent group, said ester, amide, or ester-amide derivative being selected from the group consisting of:

(1) a fatty acid amide of a polyamine of the formula:

$$NH_2(CH_2)_n-(NH(CH_2)_n)_m-NH_2$$

wherein n=2 or 3, and m is 0 to 10;

(2) a phosphoramide of an oxy- or thio-alkyl phosphorus acid with an oxyalkylated amino or a polyamine;

(3) a ester of an oxy- or thio-alkyl phosphorus acid with an oxyalkylated amine or a polyhydric alcohol;

(4) an ester-amide of an oxy- or thio-alkyl phosphorus acid with an oxyalkylated amine;

(5) a sulfonamide of an alkylsulfonic acid with an oxyalkylated amine or a polyamine;

(6) an ester of an alkylsulfonic acid with a polyhydric alcohol; and (7) a compound of the formula:

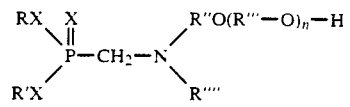

wherein each X is independently selected from sulfur and oxygen, R and R′ are independently selected from hydrocarbyl radicals containing from about 4 to 20 carbons, R″ and R‴ are, independently divalent aliphatic hydrocarbon radicals containing 1–4 carbon atoms, n is an integer from 0 to 20, and R⁗ is selected from hydrogen and the group $-R''O(R'''O)_nO$.

16. A concentrate of claim 15 which also contains, based on the total weight of concentrate, from about 40 to 60 percent by weight of ashless dispersant.

17. A concentrate of claim 15 which also contains, based on the total weight of the concentrate, from about 10 to 20 percent by weight of overbased alkaline earth metal sulfonate having a total base number of at least 100 and from about 10 and 20 percent by weight of zinc dihydrocarbyldithiophosphate.

18. A concentrate of claim 15 wherein said cosulfurized blend contains, based on the weight of the blend, from about 1 to 10 percent by weight of sulfur, and wherein said concentrate contains, based on the total weight of the concentrate, from about 40 to 60 percent by weight of ashless dispersant, from about 10 to 20 percent by weight of overbased alkaline earth metal sulfonate having a total base number of at least 100, and from about 10 to 20 percent by weight of zinc dihydrocarbyldithiophosphate.

19. A composition comprising a cosulfurized blend comprising (a) soybean oil and (b) an organic acid ester, amide, or ester-amide derivative which contains at least one polar substituent group and which is selected from the group consisting of:

(1) a fatty acid amide of a polyamine of the formula:

$$NH_2(CH_2)_n-(NH(CH_2)_m-NH_2$$

wherein n=2 or 3, and m is 0 and 10;

(2) a phosphoramide of an oxy- or thio-alkyl phosphorus acid with an oxyalkylated amine or a polyamine;

(3) an ester of an oxy- or thio-alkyl phosphorus acid with an oxyalkylated amine or a polyhydric alcohol;

(4) an ester-amide or an oxy- or thio-alkyl phosphorus acid with an oxyalkylated amine;

(5) a sulfonamide of an alkylsulfonic acid with an oxyalkylated amine or a polyamine;

(6) an ester of an alkylsulfonic acid with a polyhydric alcohol; and (7) a compound of the formula:

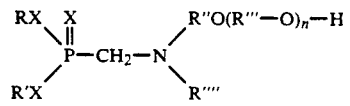

wherein each X is independently selected from sulfur and oxygen, R and R′ are independently selected from hydrocarbyl radicals containing from about 4 to 20 carbons, R″ and R‴ are divalent aliphatic hydrocarbon radicals containing 1–4 carbon atoms, n is an integer from 0 to 20, and R'''' is selected from hydrogen and the group —R''O(R'-''O)$_n$—H.

20. A composition according to claim 19 wherein said derivative is a fatty acid amide of a polyamine of the formula:

$$NH_2(CH_2)_n—(NH(CH_2)_n)_m—NH_2$$

wherein n=2 or 3, and m is b 0 and 10.

21. A composition according to claim 19 wherein said derivative is a phosphoramide of an oxy- or thio-alkyl phosphorus acid with an oxyalkylated amine or a polyamine, said oxyalkylated amine having the formula:

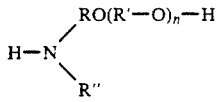

wherein R and R' are, independently, divalent aliphatic hydrocarbon radicals containing 1–4 carbon atoms, n is an integer from 0 to 20, and R'' is selected from hydrogen and the group —RO(R'O)$_n$—H.

22. A composition according to claim 19 wherein said derivative is an ester of an oxy- or thio-alkyl phosphorus acid with an oxyalkylated amine or a polyhydric alcohol, said oxyalkylated amine having the formula:

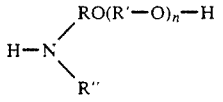

wherein R and R' are, independently, divalent aliphatic hydrocarbon radicals containing 1–4 carbon toms, n is an integer from 0 to 20, and R'' is selected from hydrogen and the group —RO(R'O)$_n$—H.

23. A composition according to claim 19 wherein said derivative is an ester-amide of an oxy- or thio-alkyl phosphorus acid with an oxyalkylated amine, said oxyalkylated amine having the formula:

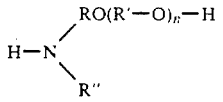

wherein R and R' are, independently, divalent aliphatic hydrocarbon radical containing 1–4 carbon atoms, n is an integer from 0 to 20, and R'' is selected from hydrogen and the group —RO(R'O)$_n$—H.

24. A composition according to claim 19 wherein said derivative is a sulfonamide of an alkylsulfonic acid with an oxyalkylated amine or a polyamine, said oxyalkylated amine having the formula:

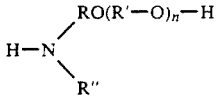

wherein R and R' are, independently, divalent aliphatic hydrocarbon radials containing 1–4 carbon atoms, n is an integer from 0 to 20, and R'' is selected from hydrogen and the group —RO(R'O)$_n$—H.

25. A composition according to claim 19 wherein said derivative is an ester of an alkylsulfonic acid with a polyhydric alcohol.

26. A composition according to claim 19 wherein said derivative is a compound of the formula:

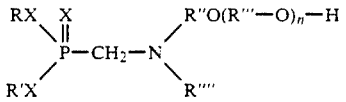

wherein each X is independently selected from sulfur and oxygen, R and R' are independently selected from hydrocarbyl radicals containing from about 4 to 20 carbons, R'' and R'' are divalent aliphatic hydrocarbon radicals containing 1–4 carbon atoms, n is an integer from 0 to 20, and R'''' is selected from hydrogen and the group —R''O(R'''O)$_n$—H.

27. A composition according to claim 19 which contains from about 1 to 10 percent by weight of sulfur, based on the weight of the composition.

* * * * *